US007343639B2

(12) United States Patent
Dranginis et al.

(10) Patent No.: US 7,343,639 B2
(45) Date of Patent: Mar. 18, 2008

(54) SCRAPER DEVICE

(75) Inventors: William M. Dranginis, Manassas, VA (US); Michael J. Vucci, Jr., Burke, VA (US); C. Jay Bradshaw, III, Leesburg, VA (US)

(73) Assignee: Ice Scraper Card, Inc., Leesburg, VA (US)

( * ) Notice: Subject to any disclaimer, the term of this patent is extended or adjusted under 35 U.S.C. 154(b) by 356 days.

(21) Appl. No.: 11/147,209

(22) Filed: Jun. 8, 2005

(65) Prior Publication Data

US 2006/0277707 A1 Dec. 14, 2006

(51) Int. Cl.
*A47L 1/06* (2006.01)
*A47L 13/02* (2006.01)

(52) U.S. Cl. ..... 15/236.02; 15/236.01; 15/236.05; 15/236.08; D32/46

(58) Field of Classification Search ..... 15/235.6, 15/236.01, 236.02, 236.05, 236.08, 245.1; 30/169; D32/46
See application file for complete search history.

(56) References Cited

U.S. PATENT DOCUMENTS

| | | | | | |
|---|---|---|---|---|---|
| 342,118 | A | * | 5/1886 | Merwin | 30/169 |
| 406,199 | A | * | 7/1889 | Cridge | 225/91 |
| 1,085,063 | A | * | 1/1914 | Prouty et al. | 119/617 |
| 1,241,779 | A | * | 10/1917 | Suydam | 15/236.08 |
| 2,277,528 | A | | 3/1942 | Osborn | |
| 2,380,855 | A | * | 7/1945 | Lower | 15/236.05 |
| 2,719,316 | A | * | 10/1955 | Hauser | 15/236.08 |
| D221,244 | S | | 7/1971 | Lawrence | |
| 4,121,316 | A | | 10/1978 | Perry | |
| 4,202,093 | A | * | 5/1980 | Wallerstein | 30/169 |
| 4,275,476 | A | | 6/1981 | Hopkins et al. | |
| 4,418,439 | A | | 12/1983 | Porchet | |
| 4,438,767 | A | * | 3/1984 | Nelson | 606/131 |
| 4,468,831 | A | | 9/1984 | Schneider | |
| 4,495,668 | A | * | 1/1985 | Adams | 15/105 |
| 4,546,513 | A | | 10/1985 | Hammond | |
| 4,712,269 | A | | 12/1987 | Worthen | |
| 4,719,660 | A | | 1/1988 | Hopkins et al. | |
| 4,747,175 | A | | 5/1988 | Durgin | |
| 4,809,386 | A | | 3/1989 | Re | |
| 4,813,458 | A | | 3/1989 | Jacobucci | |
| 4,922,569 | A | | 5/1990 | Brinker et al. | |
| D318,989 | S | | 8/1991 | Risner | |

(Continued)

FOREIGN PATENT DOCUMENTS

DE 33 41 529 A1 5/1985

(Continued)

*Primary Examiner*—Mark Spisich
(74) *Attorney, Agent, or Firm*—Law Office of Peter G. Korytnyk, PLLC

(57) ABSTRACT

A scraper device for use on motor vehicle windshields and other surfaces that require the removal of unwanted adherent matter is provided. The scraper device includes an extremely durable, credit card-sized laminate body having scraping edge surfaces that provide superior scraping capabilities. One of the scraper edge surfaces includes a first set of teeth each having a first length and a second set of teeth having a length shorter than the first length. Another scraper edge surface can include a plurality of scalloped edges. The laminate body of the scraper device can include a hard inner core layer and relatively softer top and bottom layers arranged on either side of the hard inner core layer.

20 Claims, 3 Drawing Sheets

U.S. PATENT DOCUMENTS

| | | | | |
|---|---|---|---|---|
| D320,483 | S | 10/1991 | Desautel | |
| 5,099,540 | A | 3/1992 | Paschetto | |
| 5,201,121 | A | 4/1993 | Heiberg | |
| 5,263,222 | A | 11/1993 | Johnstone, II | |
| D349,592 | S | 8/1994 | Stoll | |
| D355,281 | S | 2/1995 | Hansen et al. | |
| 5,418,998 | A | 5/1995 | Samarra | |
| 5,445,420 | A | 8/1995 | Lairmore | |
| 5,781,957 | A | 7/1998 | Scholl | |
| D403,815 | S | 1/1999 | Inerbickler | |
| 5,857,237 | A | 1/1999 | Dranginis | |
| 5,860,430 | A * | 1/1999 | Thorsheim | 132/148 |
| 6,061,913 | A | 5/2000 | Grieshaber et al. | |
| 6,205,610 | B1 * | 3/2001 | Westthorp | 15/235.4 |
| 6,618,894 | B2 | 9/2003 | Josdal | |
| D487,685 | S | 3/2004 | Zeilinger | |
| D489,582 | S | 5/2004 | Franczyk | |
| D496,836 | S | 10/2004 | Steck et al. | |
| D499,851 | S | 12/2004 | Kortleven | |
| 2003/0213085 | A1 | 11/2003 | Murphy | |
| 2003/0226579 | A1 | 12/2003 | Carrier | |
| 2006/0162111 | A1 * | 7/2006 | Miller | 15/235.6 |
| 2006/0168753 | A1 * | 8/2006 | Crisswell | 15/235.6 |

FOREIGN PATENT DOCUMENTS

| | | | |
|---|---|---|---|
| FR | 2 436 697 | | 4/1980 |
| WO | 00/26329 | * | 5/2000 |

* cited by examiner

SCRAPER DEVICE

FIELD

The present teachings relate to a scraper device for use on motor vehicle windshields and other surfaces that require the removal of unwanted adherent matter. In particular, the present teachings relate to an extremely durable credit card-sized scraper device including a laminate body having multiple scraping edge surfaces that provide superior scraping capabilities.

BACKGROUND

People confronted with small brittle ice deposits and/or snow deposits on their automobile windshield sometimes improvise by using a standard plastic wallet card, such as, a credit card, as a rudimentary scraping device. Not only is it likely that the plastic card can become permanently damaged as a result, but such cards are generally ineffective at removing ice deposits of any significance, see for example, U.S. Pat. No. 5,445,420.

Other known scraper devices are generally ineffective at removing larger ice deposits or more stubborn adherent matter, such as paint, see for example, U.S. Des. Pat. Nos. 320,483; 349,592; and 355,281.

Other approaches to the problem employ larger, more substantial devices, which may provide a handle, squeegee, and/or brush feature. Various proposals are disclosed by U.S. Pat. Nos. 4,275,476; 4,418,439; 4,468,831; 4,712,269; 4,747,175; 4,809,386; 4,922,569; and 5,263,222. Ice scraping devices with plural scraping edges have also been disclosed in U.S. Pat. Nos. 5,418,998 and 5,099,540.

A need exists for a long-lasting, low-cost, and effective pocket or wallet-sized scraper having multiple scraping edges that can be readily carried by a user. A need also exists for such a scraper having flat surfaces onto which an eye-catching, colorful, advertising message, company logo, and the like, can be imprinted. The scraper needs to have a low manufacturing cost so that it can be exchanged as a novelty item, promotional product, and the like, while providing effective long-term use as a portable scraper.

SUMMARY

An object of the invention is to solve at least the above problems and/or disadvantages and to provide at least the advantages described hereinafter.

The present teachings relate to a scraper device including a credit-card sized planar body including a top surface, a bottom surface, and a plurality of edge surfaces. At least one of the edge surfaces includes a first set of teeth each having a first length, and a second set of teeth each having a length different from the first length.

The present teachings also relate to a scraper device including a credit-card sized planar body including a top surface, a bottom surface, and a plurality of edge surfaces. The planar body includes a laminate structure including a hard inner core layer and relatively softer top and bottom layers arranged on either side of the hard inner core layer.

The present teachings also relate to a scraper device including a credit-card sized planar body including a top surface, a bottom surface, and a plurality of edge surfaces. At least one of the edge surfaces includes a scalloped scraping edge including a plurality of scalloped edges.

BRIEF DESCRIPTION OF THE DRAWINGS

The present teachings will be described in detail with reference to the following drawings in which like reference numerals refer to like elements wherein.

DESCRIPTION

Figure 1:
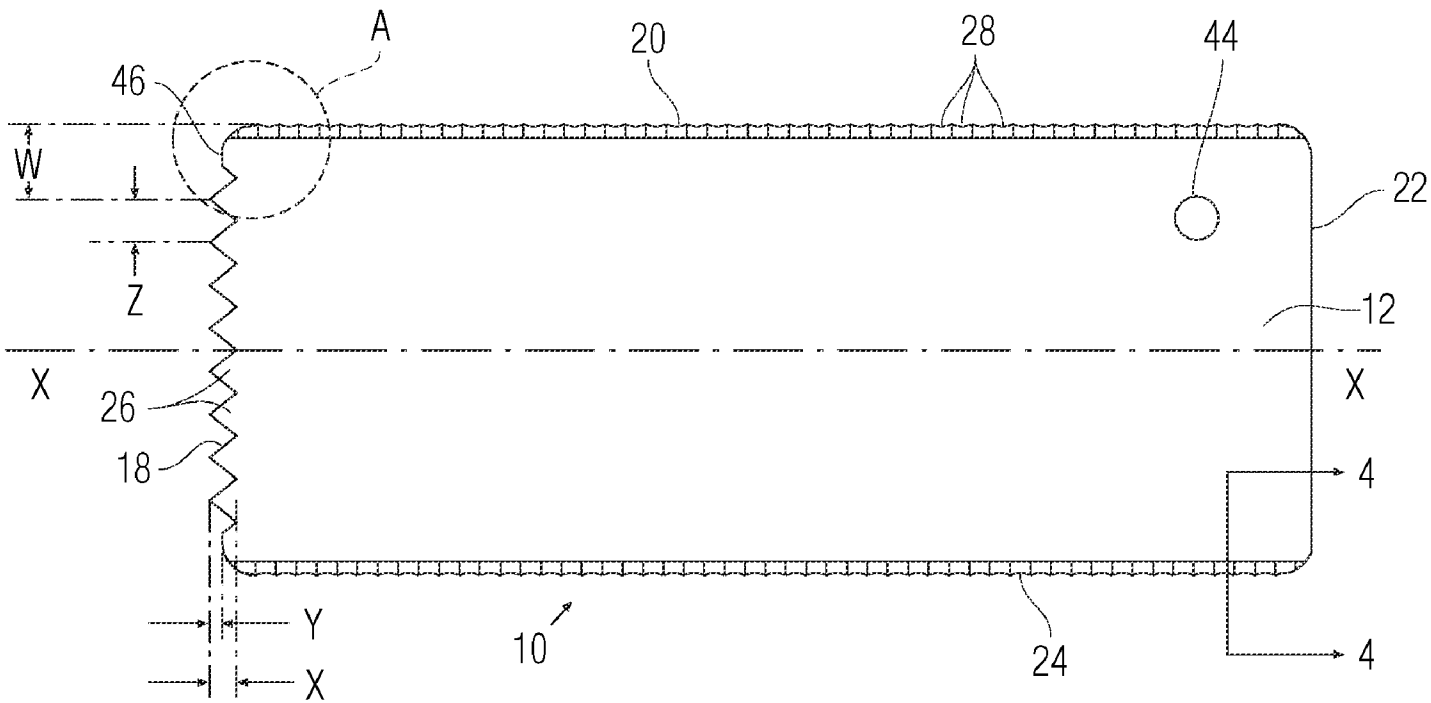
FIG. 1 shows a top plan view of the scraper device according to various embodiments.
Figure 2:
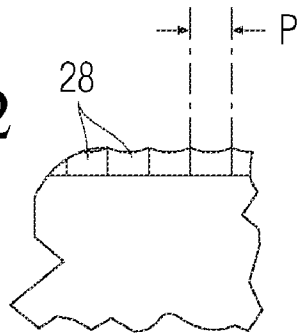
FIG. 2 shows a blown-up view of portion A of the scraper device of FIG. 1 according to various embodiments.
Figure 3:
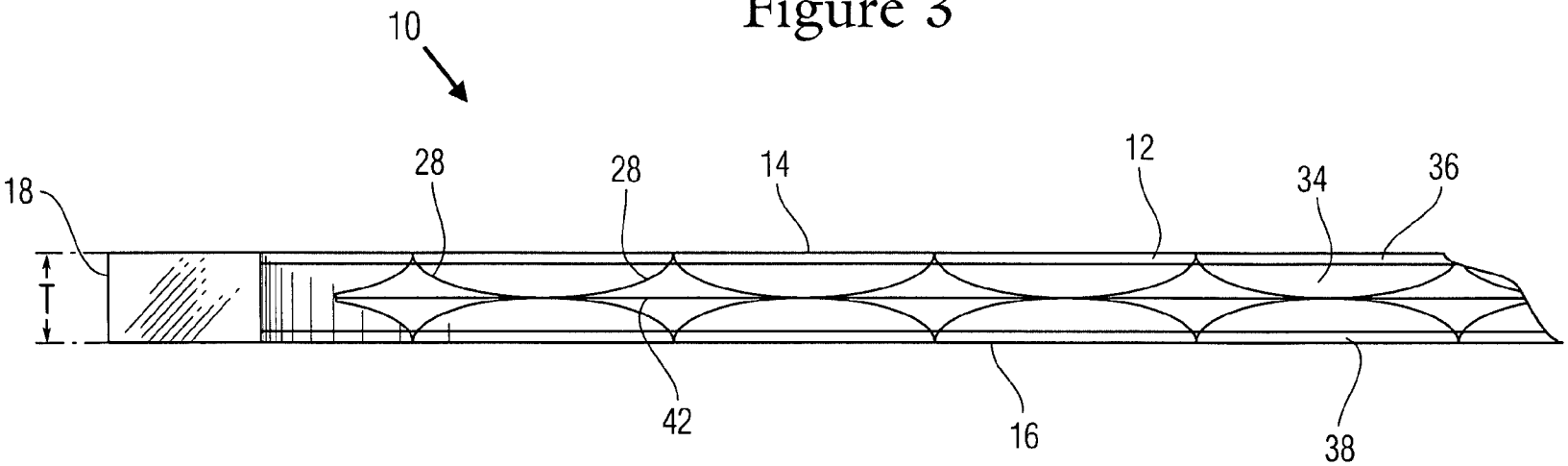
FIG. 3 shows a side view of a saw-toothed end portion of the scraper device shown in FIG. 1.

A scraper device according to various embodiments is shown in FIGS. 1-5 and is generally designated by the reference numeral 10. As shown in FIG. 3, the scraper device 10 can include a planar body 12 having a top surface 14 and a bottom surface 16. As shown in FIG. 1, the planar body 12 can be polygonal in shape and can include a plurality of edge surfaces, such as, for example, four edge surfaces designated by reference numerals 18, 20, 22, 24.

Referring to FIG. 1, an edge surface 18 of the scraper device 10 can be provided with a plurality of saw-teeth 26 sequentially arranged in a row. As will be discussed below, at one or both of the ends of the row of saw-teeth 26, the edge surface 18 can be provided with one or more recessed end teeth 46. The planar body 12 of the scraper device 10 can have a longitudinal axis, X-X, though a length of the planar body 12. The planar body 12 can be substantially symmetrical about the longitudinal axis, X-X. The configuration of the teeth on the edge surface 18 can be used to facilitate the removal of unwanted adherents from a surface, such as, for example, ice from a motor vehicle's windshield.

Figure 4:
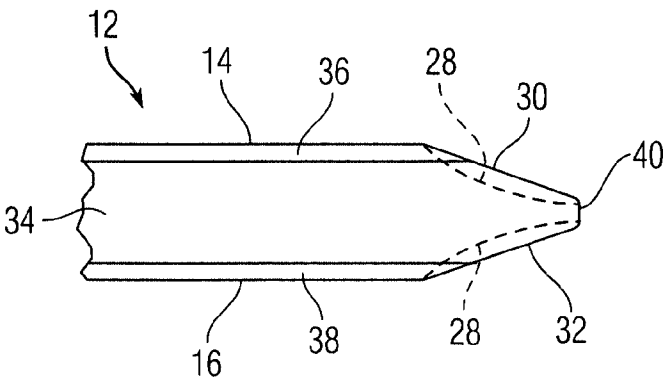
FIG. 4 shows a partial cross-sectional side view of the scraper device shown in FIG. 1 taken along line 4-4 of FIG. 1.

As also shown in FIG. 1, at least one of the edge surfaces, such as, for example, edge surfaces 20 and 24, can be provided with a series of sequentially arranged scalloped edges 28. The scalloped edges 28 can provide the user with an alternative scraping edge surface to help facilitate the removal of unwanted adherents, such as, for example, heavy frost or ice from a windshield. Referring to FIG. 4, the scalloped edges 28 can be incorporated on one or more beveled edges 30, 32 that can be angled with respect to the top surface 14 and the bottom surface 16, respectively, of the scraper device 10.

Figure 5:
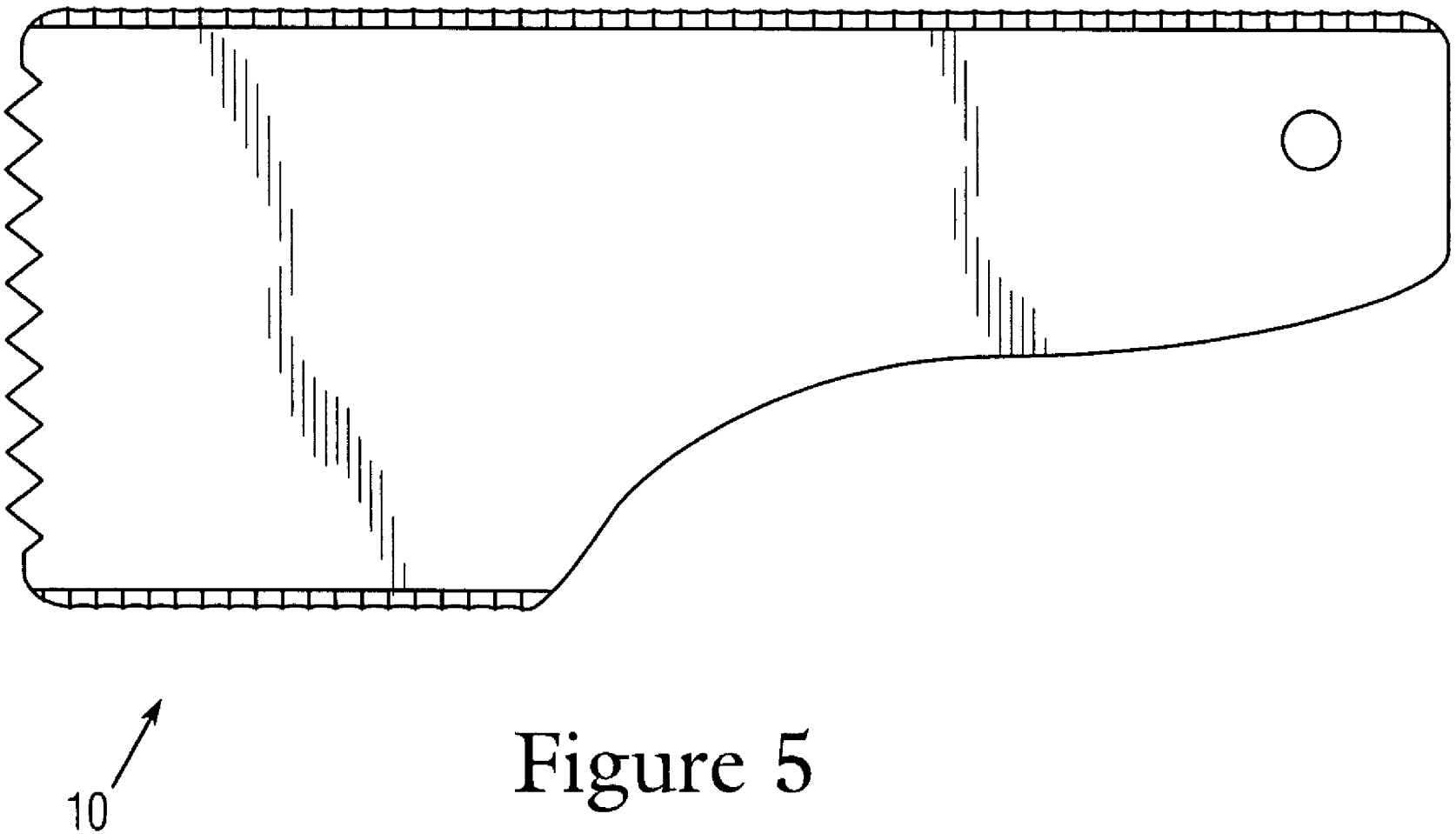
FIG. 5 shows a top plan view of a scraper device having a non-rectangular shape according to various embodiments.

According to various embodiments, the dimensions of the scraper device 10, as shown in FIG. 1, can substantially approximate those of a standard credit card, such as, for example, about 2.125 inches by about 3.375 inches. The scraper device 10 can have a square or rectangular planar shape. Alternatively, the credit-card sized scraper device 10 can have a non-rectangular shape, as shown in FIG. 5.

The thickness, T, of the scraper device 10, as shown in FIGS. 3 and 4, can be substantially equal to or greater than a standard credit card. According to various embodiments, the thickness, T, can be from about 0.025 inches to about 0.090 inches, and preferably can be about 0.058 inches.

The planar body 12 of the scraper device 10 can include a laminate structure. The laminate structure can include a hard inner core layer 34. The hard inner core layer 34 can be surrounded by relatively softer top and bottom layers 36, 38.

The hard inner core layer 34 can be made from a relatively hard material that can provide the scraper device 10 with added rigidity and strength. A harder core allows the scraper device 10 to be used more effectively as a scraping tool, such as, for example, a paint removal tool. The hard inner core layer 34 can be made from a vinyl, a plastic, and a metal. The hard inner core layer 34 can be made by stacking a plurality of layers together. The hard inner core layer 34 can be colored to provide an appealing look to the user. The thickness of the hard inner core layer 34 can be from about 0.040 inches to about 0.058 inches, and preferably can be about 0.054 inches.

At least one of the top layer 36 and the bottom layer 38 can be made from a material that is softer than the hard inner core layer 34. According to various embodiments, the top layer 36 and/or the bottom layer 38 can be made from a plastic sheet, such as, for example, white vinyl, polyester, polyvinyl chloride (PVC), polycarbonate, and ABS. The thicknesses of the top layer 36 and/or the bottom layer 38 can be from about 0.002 inches to about 0.020 inches, and preferably can be about 0.010 inches.

An advertising message, company logo, and the like, can be imprinted on either of the top layer 36 and the bottom layer 38. The image can be imprinted on these layers using a printing method employed in imprinting credit cards, such as, for example, embossing. Alternatively, a dye sublimation technique can be employed by which a desired image is heat transferred onto the body of the plastic substrate. Moreover, silkscreening techniques, offset printing, and ultraviolet printing methods can be used. The surfaces of the scraper device 10 can be provided with a protective plastic layer to protect it from scratching.

The scraper device 10 can be provided with a magnetic strip if desired on which data can be stored. The top surface 14 and/or the bottom surface 16 can include raised bumps, lines, or indented grooves to help facilitate gripping of the scraper device 10. As shown in FIG. 1, the scraper device 10 can be provided with a hole 44 through which a key ring or display rack ring can be inserted. The diameter of the hole can be about 0.15 inches to about 0.25 inches.

As shown in FIG. 1, the edge surface 18 includes a plurality of sequentially arranged saw-teeth 26. The saw-teeth 26 can have a length, X, of between about 0.050 inches to about 0.150 inches, and preferably can have a length of about 0.100 inches. The saw-teeth 26 can be provided linearly along the edge surface 18 at a repeat distance, Z, of between about 0.100 inches to about 0.300 inches, and preferably the repeat distance can be about 0.200 inches.

At one or both ends of the sequentially arranged saw-teeth 26, the edge surface 18 can be provided with one or more recessed or offset end teeth 46. The end teeth 46 can have a length that is shorter than the length of the sequentially arranged saw-teeth 26. As shown in FIG. 1, the offset end teeth 46 can be provided with a rounded or non-pointed tip. According to various embodiments, the offset end teeth 46 can be shorter than the saw-teeth 26 by an offset distance, Y, of between about 0.010 inches to about 0.125 inches, and preferably the offset distance can be about 0.040 inches. The planar body 12 can be substantially symmetrical about the longitudinal axis, X-X. Accordingly, during scraping, the longer saw-teeth 26 of the edge surface 18 contact the adherent material first, thereby allowing the placement of a more concentrated force or pressure onto the material to be removed. Moreover, by incorporating offset end teeth 46, wear on the saw-teeth 26 can be decreased, thereby increasing the operating life of the scraper device 10.

According to various embodiments, a beveled edge including scalloping can be provided in a right-hand or a left-hand orientation with respect to the edge surface 18. Scalloped beveled edges can be provided relative to the saw-toothed edge surface 18 so that the user is not required to reorient the scraper device 10 when switching between scraping operations utilizing different edge surfaces, such as edge surfaces 18, 20, 22, 24. As shown in FIG. 4, the necessity to reorient the scraper device 10 can be avoided by providing a double bevel including beveled surfaces 30, 32 along an edge surface. Alternatively, a single bevel surface can be provided along an edge surface. The bevel angle of any beveled surfaces 30, 32 can range from about 10 degrees to about 90 degrees with respect to either the top surface 14 or the bottom surface 16 of the scraper device 10. Preferably, a bevel angle can be in the range of about 20 degrees, plus/minus about 15 degrees.

As shown in FIGS. 1, 2, and 4, the edge surfaces 20 and 24 can be provided with a series of sequentially arranged scalloped edges 28. The scalloped edges 28 can be incorporated on one or more of the beveled surfaces 30, 32. The scalloped edges 28 can be produced by various manufacturing processes, such as, for example, mechanical milling and injection molding. Referring to FIG. 2, a pitch distance, P, measured between peaks of each scalloped edge 28 can be from between about 0.062 inches and about 0.250 inches, and preferably the pitch distance can be about 0.105 inches. The scalloped edges 28 provide a scraping edge with a robust and effective scraping surface for facilitating the removal of unwanted adherents.

As shown in FIG. 4, the beveled surfaces 30, 32 including the scalloped edges 28 can be provided with a flattened tip 40. The flattened tip 40 can extend substantially perpendicularly with respect to the planar body 12 of the scraper device. The use of a flattened tip 40 facilitates manufacture and increases the durability of the scraper device. Alternatively, the beveled edges 30, 32 can meet at a non-flattened tip 42, as shown in FIG. 3.

The scraper device 10 of the present teachings can be conveniently made in small quantities by machining it from a selected sheet of material, such as a plastic, or from several sheets of laminated material. Alternatively, when large quantities of devices are desired, the scraping device 10 can be manufactured by injection molding.

A preferred method of manufacturing the scraper device 10 of the present teachings entails laminating together the hard inner core layer 34 between the relatively softer top layer 36 and bottom layer 38. Then any lettering, logos, borders, and the like, desired for the face of the scraper device 10 can be applied by, for example, silkscreening. Alternatively, the imprinting can be personalized or customized by printing on it with an ink-jet printer, or the like. The scraper device can then be sealed, for example, heat sealed with a clear vinyl laminate, to protect the imprinted design. The laminated sheet can then be fused by applying conventional heat and pressure conditions thereto. A blank can then be punched out of the laminate with, for example, a press punch. The punch can be shaped so that the tooth arrangements discussed above can be provided on the blank. A key ring hole can also be provided at this point if desired. The blank can then be provided with one or more beveled surfaces and with scalloped edges by way of machining operations. If desired, a flattened tip can be formed at the end of the beveled surface.

An alternative manufacturing method entails laminating together a plurality of plastic sheets, for example, using colored plastic, then punching out the laminate to form the tooth arrangements discussed above. The blanks can be machined to provide beveled surfaces and scalloped edges as needed to form the desired scraping edges. An adhesive label can be applied to a face of the scraper device, which label contains desired lettering, logos, borders, and the like. A clear protective laminate can then be applied if desired.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A scraper device comprising:

a credit-card sized substantially planar body having length and width dimensions not exceeding those of a standard credit card, the planar body including a top surface, a bottom surface, and a plurality of edge surfaces, the substantially planar body having a longitudinal axis through the length of the planar body;

wherein the substantially planar body includes a laminate structure including a hard inner core layer and relatively softer top and bottom layers arranged on either side of the hard inner core layer;

wherein at least one of the edge surfaces includes a row of sequentially arranged saw-teeth each having a first length, and at least one end tooth arranged at each end of the row of sequentially arranged saw-teeth, each end tooth having a second length which is shorter than the first length; and wherein the substantially planar body is substantially symmetrical about the longitudinal axis.

2. The scraper device of claim 1, wherein at least one of the edge surfaces includes a scalloped scraping edge including a plurality of scalloped edges.

3. The scraper device of claim 2, wherein the plurality of scalloped edges are formed in the hard inner core layer and in at least one of the relatively softer top and bottom layers.

4. The scraper device of claim 3, wherein the plurality of scalloped edges are formed on a beveled surface extending from one of the top surface and the bottom surface of the substantially planar body.

5. The scraper device of claim 4, wherein the plurality of scalloped edges are formed on a beveled surface extending from each of the top surface and the bottom surface of the substantially planar body.

6. The scraper device of claim 1, wherein the hard inner core layer is thicker than each of the top and bottom layers.

7. A scraper device comprising:

a credit-card sized substantially planar body having length and width dimensions not exceeding those of a standard credit card, the planar body including a top surface, a bottom surface, and a plurality of edge surfaces;

wherein the substantially planar body includes a laminate structure including a hard inner core layer and relatively softer top and bottom layers arranged on either side of the hard inner core layer, the hard inner core layer being thicker than each of the top and bottom layers;

wherein the plurality of edge surfaces includes at least three scraping edges, each scraping edge formed by the hard inner core layer and at least one of the relatively softer top and bottom layers; and wherein the substantially planar body has a thickness of about 0.090 inches or less.

8. The scraper device of claim 7, wherein at least one of the edge surfaces includes a first set of teeth each having a first length and a second set of teeth each having a length different from the first length, each of the second set of teeth having substantially the same length and being shorter than the first length.

9. The scraper device of claim 7, wherein the hard inner core layer is made from one of vinyl, plastic, and metal.

10. The scraper device of claim 9, wherein the hard inner core layer includes a plurality of laminated layers.

11. The scraper device of claim 7, wherein at least one of the relatively softer top and bottom layers are made of plastic sheet.

12. The scraper device of claim 11, wherein at least one of the relatively softer top and bottom layers is made of white vinyl.

13. The scraper device of claim 7, wherein the credit-card sized substantially planar body is non-rectangular in shape.

14. The scraper device of claim 7, wherein the substantially planar body has a longitudinal axis extending through a length thereof, the planar body being substantially symmetrical about the longitudinal axis.

15. A scraper device comprising:

a credit-card sized substantially planar body having length and width dimensions not exceeding those of a standard credit card, the planar body including a top surface, a bottom surface, and a plurality of edge surfaces, the substantially planar body having a longitudinal axis through the length of the planar body;

wherein the substantially planar body includes a laminate structure including a hard inner core layer and relatively softer top and bottom layers arranged on either side of the hard inner core layer;

wherein at least one of the edge surfaces extending along the length of the substantially planar body includes a scalloped scraping edge including a plurality of scalloped edges;

wherein at least one of the edge surfaces extending along the width of the substantially planar body includes a row of sequentially arranged saw-teeth each having a first length, and a single end tooth arranged at each end of the row of sequentially arranged saw-teeth, each end tooth having a second length which is shorter than the first length; and wherein the substantially planar body is substantially symmetrical about the longitudinal axis.

16. The scraper device of claim 15, wherein the plurality of scalloped edges are formed in the hard inner core layer and in at least one of the relatively softer top and bottom layers.

17. The scraper device of claim 15, wherein the plurality of scalloped edges are formed on a beveled surface extending from one of the top surface and the bottom surface of the planar body, the plurality of scalloped edges being formed in the hard inner core layer and in at least one of the relatively softer top and bottom layers.

18. The scraper device of claim 17, wherein the plurality of scalloped edges are formed on a beveled surface extending from each of the top surface and the bottom surface of the substantially planar body.

19. The scraper device of claim 17, wherein each scalloped edge defines a pitch distance between respective scalloped peaks, the pitch distance being from about 0.062 inches to about 0.250 inches.

20. The scraper device of claim 15, wherein the hard inner core layer is thicker than each of the top and bottom layers.

* * * * *